US008710473B2

(12) United States Patent
Mizoguchi et al.

(10) Patent No.: US 8,710,473 B2
(45) Date of Patent: Apr. 29, 2014

(54) DROPLET GENERATION AND DETECTION DEVICE, AND DROPLET CONTROL DEVICE

(75) Inventors: Hakaru Mizoguchi, Oyama (JP); Kouji Kakizaki, Hiratsuka (JP); Osamu Wakabayashi, Hiratsuka (JP); Masahiro Inoue, Hiratsuka (JP)

(73) Assignee: Gigaphoton Inc., Tochigi (JP)

( * ) Notice: Subject to any disclaimer, the term of this patent is extended or adjusted under 35 U.S.C. 154(b) by 179 days.

(21) Appl. No.: 13/283,849

(22) Filed: Oct. 28, 2011

(65) Prior Publication Data

US 2012/0104289 A1 May 3, 2012

(30) Foreign Application Priority Data

Oct. 29, 2010 (JP) ..... 2010-243050
Mar. 30, 2011 (JP) ..... 2011-073810
Jul. 27, 2011 (JP) ..... 2011-164161

(51) Int. Cl.
*H05G 2/00* (2006.01)

(52) U.S. Cl.
USPC ..... 250/504 R; 250/423 R; 250/423 F; 250/423 P; 250/424; 250/425

(58) Field of Classification Search
USPC ..... 250/423 R, 423 F, 423 P, 424, 425, 250/493.1, 503.1, 504 R
See application file for complete search history.

(56) References Cited

U.S. PATENT DOCUMENTS 7,087,914 B2 8/2006 Akins et al.
2008/0248585 A1* 10/2008 Chen et al. ..... 436/89
2009/0272919 A1* 11/2009 Abe et al. ..... 250/504 R

* cited by examiner

*Primary Examiner* — Robert Kim
*Assistant Examiner* — Hanway Chang
(74) *Attorney, Agent, or Firm* — McDermott Will & Emery LLP

(57) ABSTRACT

A droplet generation and detection device may include: a droplet generation unit for outputting a charged droplet; at least one droplet sensor including a magnetic circuit including a coil configured of an electrically conductive material, the magnetic circuit being disposed such that the charged droplet passes around the magnetic circuit, and a current detection unit for detecting current flowing in the coil and outputting a detection signal; and a signal processing circuit for detecting the charged droplet based on the detection signal.

10 Claims, 14 Drawing Sheets

DROPLET GENERATION AND DETECTION DEVICE, AND DROPLET CONTROL DEVICE

CROSS-REFERENCE TO RELATED APPLICATIONS

The application claims priority of Japanese Patent Application No. 2010-243050, filed Oct. 29, 2010, Japanese Patent Application No. 2011-073810, filed Mar. 30, 2011, and Japanese Patent Application No. 2011-164161, filed Jul. 27, 2011, the entire contents of each of which are hereby incorporated by reference.

BACKGROUND

1. Technical Field

This disclosure relates to a droplet generation and detection device, and a droplet control device.

2. Related Art

Photolithography processes have been continuously improving for semiconductor device fabrication. Extreme ultraviolet (EUV) light at a wavelength of approximately 13 nm is useful in the photolithography processes to form extremely small features (e.g., 32 nm or less features) in, for example, semiconductor wafers.

Three types of systems for generating EUV light have been well known. The systems include an LPP (Laser Produced Plasma) type system in which plasma generated by irradiating a target material with a laser beam is used, a DPP (Discharge Produced Plasma) type system in which plasma generated by electric discharge is used, and an SR (Synchrotron Radiation) type system in which orbital radiation is used.

SUMMARY

A droplet generation and detection device according to one aspect of this disclosure may include: a droplet generation unit for outputting a charged droplet; at least one droplet sensor including a magnetic circuit including a coil configured of an electrically conductive material, the magnetic circuit being disposed such that the charged droplet passes around the magnetic circuit, and a current detection unit for detecting current flowing in the coil and outputting a detection signal; and a signal processing circuit for detecting the charged droplet based on the detection signal.

A droplet control device according to another aspect of this disclosure may include: at least one droplet sensor including a magnetic circuit including a coil configured of an electrically conductive material, and a current detection unit for detecting current flowing in the coil and outputting a detection signal; a signal processing circuit for detecting the charged droplet based on the detection signal from the droplet sensor; and a trajectory control unit for controlling a trajectory of the charged droplet.

An extreme ultraviolet light generation chamber according to yet another aspect of this disclosure may be used in an extreme ultraviolet light generation apparatus, and the extreme ultraviolet light generation chamber may include: a chamber body; a droplet generation unit for outputting a charged droplet into the chamber body; at least one droplet sensor including a magnetic circuit including a coil configured of an electrically conductive material, the magnetic circuit being disposed such that the charged droplet passes around the magnetic circuit, and a current detection unit for detecting current flowing in the coil and outputting a detection signal; and a signal processing circuit for detecting the charged droplet based on the detection signal from the droplet sensor; and a trajectory control unit for controlling a trajectory of the charged droplet.

A method for controlling a position of a charged droplet in an extreme ultraviolet light generation apparatus according to still another aspect of this disclosure may include: disposing, around a trajectory of a charged droplet, at least one droplet sensor including a magnetic circuit including a coil configured of an electrically conductive material, the magnetic circuit being disposed such that the charged droplet passes around the magnetic circuit, and a current detection unit for detecting current flowing in the coil and outputting a detection signal; causing the droplet generation unit to output the charged droplet; detecting the charged droplet based on the detection signal from the droplet sensor; and generating an electric field in a region containing part of the trajectory of the charged droplet, the direction of the electric field intersecting the trajectory.

DESCRIPTION OF THE EMBODIMENTS

Hereinafter, selected embodiments of this disclosure will be described in detail with reference to the accompanying drawings. According to the embodiments of this disclosure, a position of a charged droplet may be detected accurately and precisely for a relatively long period of time.

In the embodiments of this disclosure, focusing on a charge of a charged droplet, the charged droplet may be detected using a magnetic circuit. Further, in the embodiments of this disclosure, a trajectory (traveling direction) of a charged droplet may be controlled by an electric field to act on the charged droplet.

The embodiments to be described below are merely illustrative and do not limit the scope of this disclosure. Further, configurations and operations described in each embodiment are not all essential in implementing this disclosure. It should be noted that like elements will be referenced by like referential symbols, and duplicate descriptions thereof will be omitted herein.

First Embodiment

Figure 1:
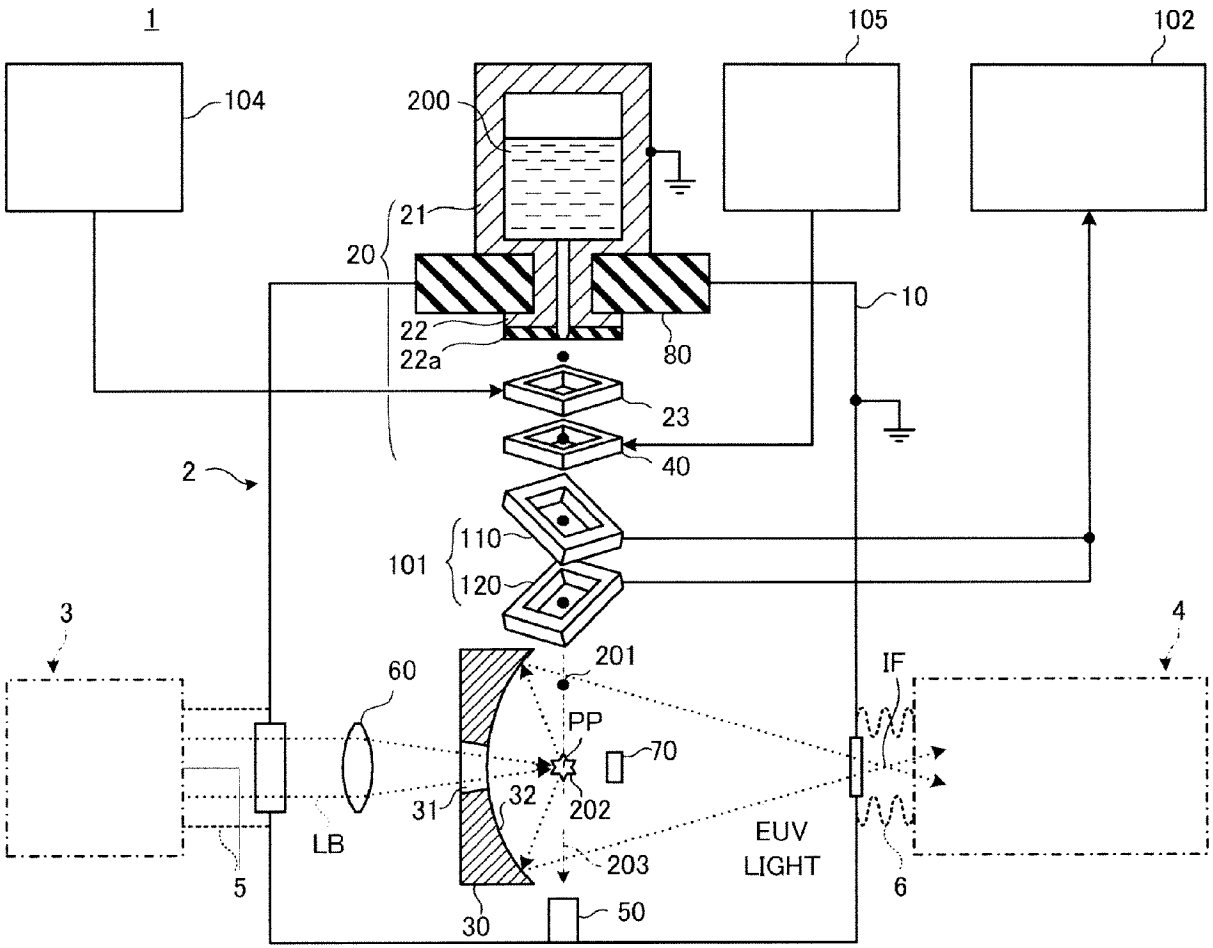
FIG. 1 schematically illustrates a general configuration of an EUV exposure system, to which an EUV light generation chamber according to a first embodiment is applied.

A first embodiment will be described with reference to FIGS. 1 through 6. FIG. 1 schematically illustrates a general configuration of an EUV exposure system 1, to which an EUV light generation chamber according to the first embodiment may be applied. The EUV exposure system 1 may include an EUV light generation chamber apparatus 2, a driver laser apparatus 3, and an EUV exposure apparatus 4, for example.

The EUV light generation chamber apparatus 2 may include a chamber 10, a droplet generator 20, a collector mirror 30, a collection unit 50, a laser beam focusing optical system 60, a beam dump 70, a mount 80, a group 101 of droplet sensors. Further, the EUV light generation chamber apparatus 2 may be connected to a droplet position detection circuit 102. The EUV light generation chamber apparatus 2 and the driver laser apparatus 3 may constitute an EUV light generation system.

General operation of the EUV light generation system will be described first, and then a method for detecting the position of a droplet will be described.

The interior of the chamber 10 may be maintained at low pressure. EUV light generated inside the chamber 10 may be focused on an intermediate focus (IF) defined inside a connection 6 positioned between the chamber 10 and the EUV exposure apparatus 4, and be outputted to the EUV exposure apparatus 4.

The droplet generator 20 may be mounted to the chamber 10 via the mount 80. The mount 80 may comprise a member having heat-insulating properties and airtightness properties so as to maintain the interior of the chamber 10 at low pressure. The mount 80 may further have electrical insulating properties.

The droplet generator 20 may include a main body 21, a nozzle unit 22, a first electrode 23, and a second electrode 40. The nozzle unit 22 may be provided at the leading end side of the main body 21. An insulation member 22*a* having an opening may be fixed to the nozzle unit 22. The first electrode 23 may be disposed with a predetermined gap between the first electrode 23 and the insulation member 22*a*. The second electrode 40 may be disposed with an insulation member (not shown) and a predetermined gap provided between the second electrode 40 and the first electrode 23. A pulse voltage generation circuit 104 may be connector to the first electrode 23, and a constant voltage source 105 may be connected to the second electrode 40.

A material serving as a source of droplets (target material 200) may be stored inside the main body 21. Tin (Sn) may be used as the target material 200, but the target material 200 is not limited thereto. The target material 200 inside the main body 21 may be heated by a heating device such as a heater (not shown) and maintained in a molten state. The target material 200 inside the main body 21 may not need to be in a molten state at any time. It may be necessary that the target material 200 be in a molten state at least when the target material is outputted through the nozzle unit 22.

A charged droplet 201 may be outputted from such droplet generator 20. For example, the droplet generator 20, the target material 200, and the chamber 10 may be set at the ground potential, and a predetermined pulse potential, which differs from the ground potential, may be applied to the first electrode 23 at predetermined timing by the pulse voltage generation circuit 104.

The first electrode 23 may be disposed to face the nozzle unit 22 provided with an opening formed at a tip thereof. The first electrode 23 may be annular in shape. When the pulse potential is applied to the first electrode 23, the molten target material 200 may slightly project from the nozzle unit 22 due to the electrostatic force. Since the electric field may be enhanced at the projected target material 200, the electrostatic force may act on the projected target material 200 more intensely. Therefore, the target material 200 may be pulled out from the nozzle unit 22. The pulled-out target material 200 may be turned into a droplet 201. The droplet 201 pulled out with the electrostatic force may be charged.

Alternatively, the droplet generator 20 may be configured such that the target material 200 is caused to project slightly from the nozzle unit 22 by having pressure applied to the target material 200. For example, a piezoelectric element may be disposed on a side wall of the nozzle unit 22 and the piezoelectric element may be caused to deform at predetermined timing. Thus, the target material 200 may be caused to project slightly from the nozzle unit 22. When the pulse potential is applied to the first electrode 23 after the target material 200 projects from the nozzle unit 22, the target material 200 may be outputted from the nozzle unit 22. The outputted droplet 201 may be charged in this case as well.

Since the droplet 201 outputted from the nozzle unit 22 may be charged, the droplet 201 may be accelerated by an electric field generated by a potential applied to the second electrode 40. Accordingly, the droplet 201 can move toward the plasma generation region PP.

In synchronization with timing at which the droplet 201 arrives in the plasma generation region PP, the droplet 201 may be irradiated with a laser beam LB outputted from the driver laser apparatus 3. The driver laser apparatus 3 may be a $CO_2$ pulse laser apparatus.

The laser beam LB outputted from the driver laser apparatus 3 may travel through a laser beam path pipe 5 between the driver laser apparatus 3 and the chamber 10, and enters the chamber 10. The laser beam LB may strike the droplet 201 via the laser beam focusing optical system 60 and a through-hole 31 provided in the collector mirror 30.

When the droplet 201 is irradiated with the laser beam LB, the droplet 201 is turned into plasma 202, and EUV light is emitted from the plasma 202. The EUV light is then reflected by a reflective surface 32 of the collector mirror 30, and is focused on the intermediate focus IF.

The beam dump 70 may be disposed, toward which the laser beam LB passing through the through-hole 31 may travel. The beam dump can absorb the energy of the laser beam LB which has not struck the droplet 201 and convert the energy into thermal energy. Accordingly, in order to prevent the beam dump 70 from being overheated, the beam dump 70 may be provided with a cooling mechanism. Aside from the beam dump 70, other elements may be provided with a cooling mechanism when it is necessary to cool the elements so as to prevent them from being overheated due to diffuse light of the laser beam LB or radiation from the plasma 202.

When the droplet 201 is irradiated with the laser beam LB, debris may be generated in some cases. The debris may include a residue of the droplet 201 having been irradiated with the laser beam LB. The debris may be collected by the collection unit 50, disposed inside the chamber 10, facing the droplet generator 20. Further, of droplets 201 outputted from the droplet generator 20, droplets 201 which have not been irradiated with the laser beam LB may be collected by the collection unit 50 as well.

The group 101 of the droplet sensors may be disposed on a trajectory 203 of the droplet 201 between the droplet generator 20 and the plasma generation region PP. Detailed arrangement of the group 101 of the droplet sensors will be described later with reference to FIG. 4.

The droplet position detection circuit 102 may include a signal processing circuit. The droplet position detection circuit 102 is electrically coupled to droplet sensors 110 and 120 constituting the group 101 of the droplet sensors. The droplet position detection circuit 102 processes a detection signal from at least either of the droplet sensors 110 and 120 to calculate the position of the charged droplet 201.

Figure 9:
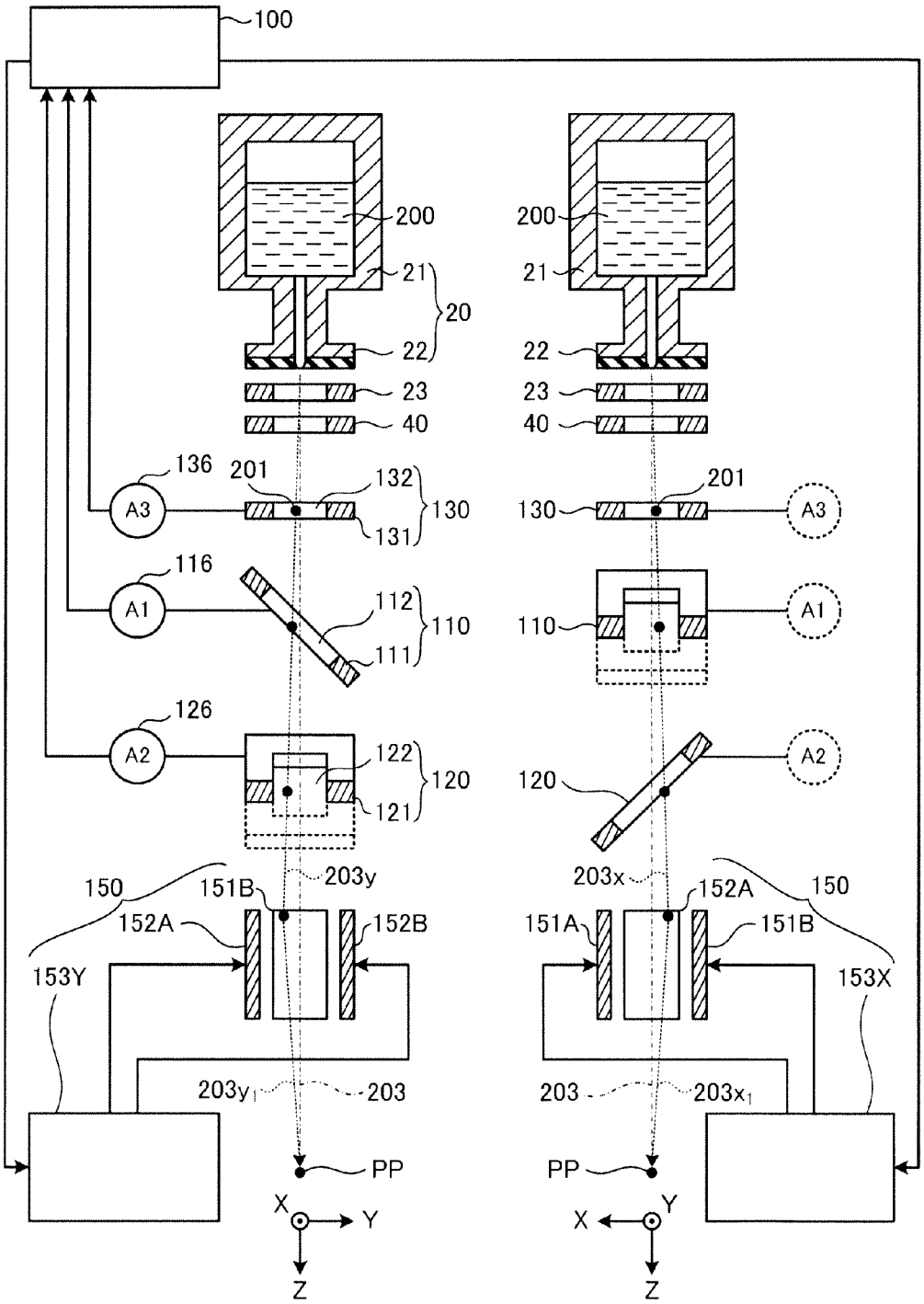
FIG. 9 is a general view of a droplet control device.

Potential to be applied to the first electrode 23 and the second electrode 40, respectively, may be controlled based on a control signal from a droplet controller (See FIG. 9).

Figure 2:
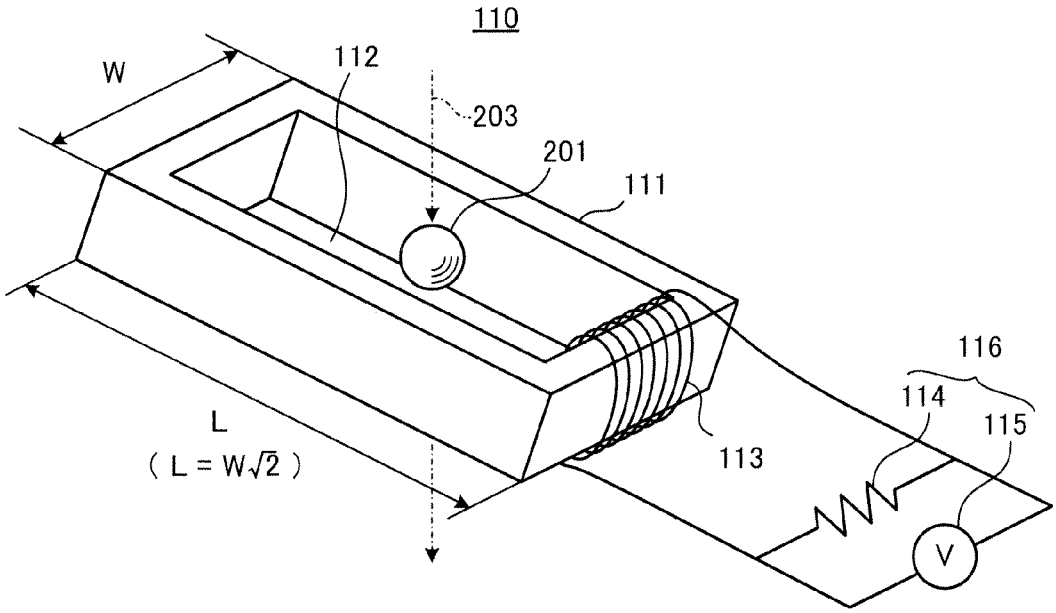
FIG. 2 is a perspective view of a droplet sensor.

FIG. 2 is a perspective view of a droplet sensor. The first droplet sensor 110 will be illustrated as an example with reference to FIG. 2. The second droplet sensor 120, a third droplet sensor 130, and a fourth droplet sensor 140 to be described later may be configured similarly to the first droplet sensor 110.

The first droplet sensor 110 may include a core 111, a coil 113, and ammeter 116. A material of the core 111 may be a ferromagnetic material, such as ferrite, FINEMET®, a neodymium magnet, a samarium-cobalt magnet, or soft steel. The core 111 may be formed into a loop having an opening 112. The opening 112 may be in any of various frame shapes, such as annular, rectangular, triangular, and polygonal, as viewed from above. Further, as will be described later, a curved core may be used in place of a planar core.

The core 111 made of the magnetic material may be formed to have a closed loop shape, and may preferably be disposed so that the charged droplet 201 passes through the opening 112 of the core.

The coil 113 may be wound around at least a part of the core 111. The coil 113 may be connected, at both ends thereof, to a resistance 114. A voltmeter 115 may detect a voltage between the two ends of the resistance 114.

When the charged droplet 201 passes through the opening 112 of the core 111 made of the magnetic material in the direction shown by an arrow 203, a magnetic flux may be generated through the core 111. The magnetic flux may cause induced electromotive force to be generated in the coil 113, and thus induced current may flow in the coil 113. The induced current may cause a voltage to be generated between the two ends of the resistance 114, and the voltage may be measured by the voltmeter 115. That is, the resistance 114 and the voltmeter 115 may constitute the ammeter 116 for detecting the induced current generated as the droplet 201 passes through the opening 112 of the core 111. The ammeter 116 may output a detection signal representing a waveform of the induced current to the droplet position detection circuit 102 (See FIG. 1), for example.

When the length of the flux path of the magnetic circuit including the core 111 becomes shorter, that is, the core 11 becomes smaller, it may be possible to increase the current, caused by the droplet 201 passing through the opening 112, to flow in the coil 113. Further, increasing a charge quantity of the droplet 201 may make it possible to increase the current to flow in the coil 113. In the first embodiment, a configuration in which the droplet 201 is pulled out from the droplet generator 20 with the electrostatic force may be employed. This may allow the droplet 201 of a small diameter to be charged. As an example, a width W of the core 111 may be set to 0.6 mm, and a length L thereof may be set to 0.85 mm ($L=\sqrt{2}$), for example. These numerical values are merely examples, and this disclosure is not limited thereto.

In the example shown in FIG. 2, the core 111 has a rectangular frame shape, as viewed from above. However, as described above, the core 111 may have various shapes, such as circular, elliptic, or polygonal, and so forth. That is, core 111 may have any shape and be made of any material as long as the magnetic flux is generated in the core 111 when the charged droplet 201 passes near the core 111.

Figure 3A:
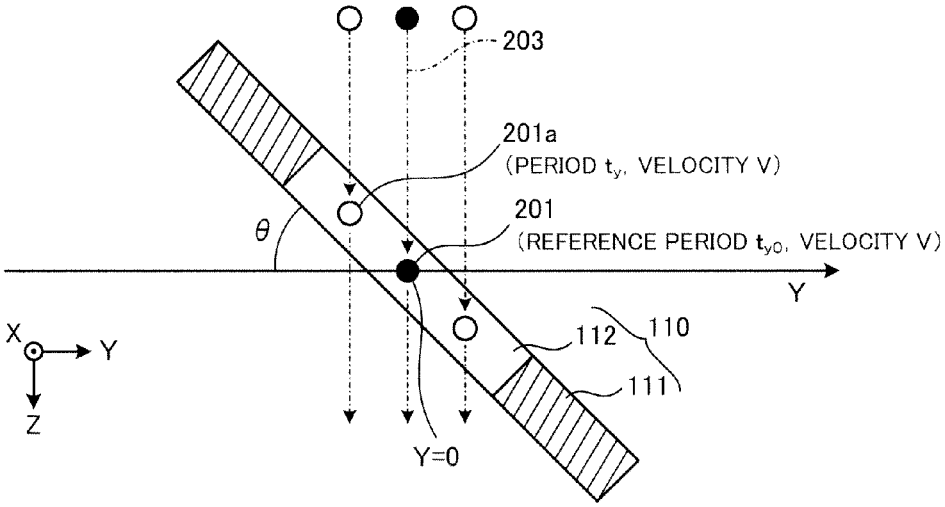
FIG. 3A schematically illustrates a mechanism by which a position of a charged droplet is detected.
Figure 3B:
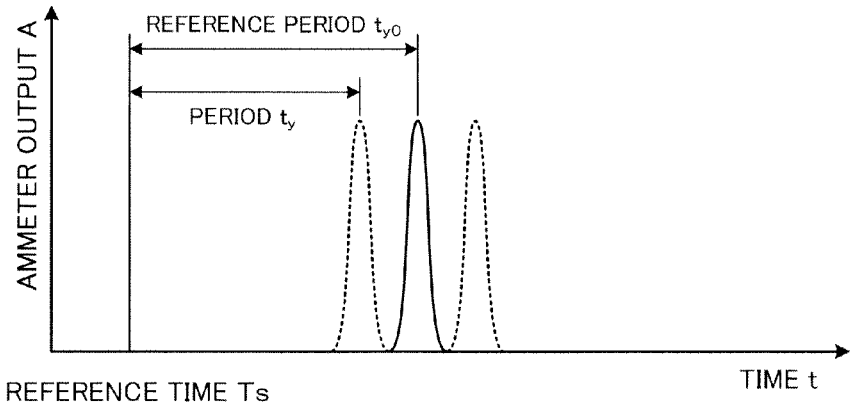
FIG. 3B is a timing chart illustrating a mechanism by which the position of the charged droplet is detected.

FIGS. 3A and 3B illustrate the mechanism for detecting the position of the droplet 201 by the magnetic circuit. The first droplet sensor 110 will be illustrated as an example, but the second droplet sensor 120 may be configured to detect the position of the droplet 201 with a similar mechanism.

For example, the position Y=0 on the Y-axis may be set as the reference position in Y-direction on a trajectory along which the droplet 201 travels. When the droplet 201 passes the reference position (Y=0) in Y-direction, an amount of positional deviation in Y-direction may be detected to be 0.

In the graph shown in FIG. 3B, the vertical axis represents the current flowing through the coil 113, and the horizontal axis represents time. That is, the graph shows the current waveform and the detection timing of the detection signal. The detection timing may be a time at which the current waveform is at its peak. However, without being limited thereto, the detection timing may be set to a time at which the current value in the current waveform is at a half of the peak value, or a time at which the current value in the current waveform is at or above a predetermined current value.

A reference time Ts may represent a time serving as a reference for measuring the amount of positional deviation of the droplet 201. As an example, the reference time Ts may be the timing at which the pulse potential is applied to the first electrode 23 of the droplet generator 20 from the pulse voltage generation circuit 104 (See FIG. 1) based on the control signal from the droplet controller (See FIG. 9). Alternatively, the reference time Ts may be a time at which the droplet 201 passes through another sensor (for example the third droplet sensor 130 to be described later) disposed at a given position on the trajectory 203 of the droplet 201 between the droplet generator 20 and the plasma generation region PP.

A reference period $T_{y0}$ may be a time difference between the reference time Ts and the time at which the detection signal by the first droplet sensor 110 is detected as the droplet 201 passes the reference position in Y-direction.

The first droplet sensor 110 may preferably be disposed so as to be inclined at a predetermined angle θ with respect to a plane orthogonal to the trajectory 203 of the droplet 201. To be more specific, the first droplet sensor 110 may preferably be disposed so as to be inclined at the predetermined angle θ about the X-axis (axis orthogonal to the paper face in FIG. 3A). The Z-axis represents the trajectory 203 of the droplet 201.

In accordance with the inclination at the predetermined angle θ, the position of the droplet 201 in Y-direction may be measured. For example, a case in which a droplet 201*a* does not pass the reference position (Y=0) in Y-direction will be considered. In this case, a period $t_y$ from the reference time Ts to a time at which the droplet 201*a* passes through the first droplet sensor 110 may change with respect to the reference period $t_{y0}$ in accordance with a distance between the reference position (Y=0) and a position in Y-direction corresponding to the position at which the droplet 201*a* passes through the first droplet sensor 110. In accordance with this, the timing at which the detection signal is outputted may change as well. That is, by disposing the first droplet sensor 110 so as to be inclined at the predetermined angle θ, the distance between the reference position (Y=0) and the passing position may be detected as a temporal difference between the reference period $t_{y0}$ and the period $t_y$.

Meanwhile, a case in which a droplet sensor can be disposed in parallel to a plane orthogonal to the trajectory 203, as in the third droplet sensor 130 and the fourth droplet sensor 140 to be described later, will be considered. In this case, the third droplet sensor 130 and the fourth droplet sensor 140 may be configured such that a change in timing at which current flows through the coils of the respective droplet sensors 130 and 140 may be small even when the passing position of the droplet 201 is deviated. Thus, this configuration may be useful when a time at which the droplet 201 passes a droplet sensor needs to be detected.

The position of the droplet may be calculated as follows. The period $t_y$ may be a temporal difference between the reference time Ts and the time at which the droplet 201*a* to be measured passes through the opening 112 of the first droplet sensor 110. When $T_y$ represents a temporal difference between the period $t_y$ and the reference period $T_{y0}$, $T_y$ may be represented with Expression (1) below.

$$T_y = t_y - t_{y0} \quad (1)$$

Further, when velocity V of the droplet 201 and the predetermined angle θ are known, a position $P_y$ with respect to the reference position in Y-direction of the droplet 201 may be calculated using Expression (2) below.

$$P_y = V \cdot T_y / \tan\theta \quad (2)$$

In this way, the position of the droplet in Y-direction may be calculated.

To simplify the calculation, the predetermined angle θ may be set to 45 degrees so that tan θ is equal to 1. In this case, the core 111 may preferably be configured such that the length L is √2 times the width W.

The velocity V of the droplet 201 may not be known in some cases. If this is the case, it may be preferable that a distance L between the measuring positions at the reference period $t_{y0}$ (distance between the position at which the reference time Ts is measured and the first droplet sensor 110) be measured. By measuring distance L, the velocity V may be calculated with Expression (3) below.

$$V = L / t_{y0} \quad (3)$$

Figure 4:
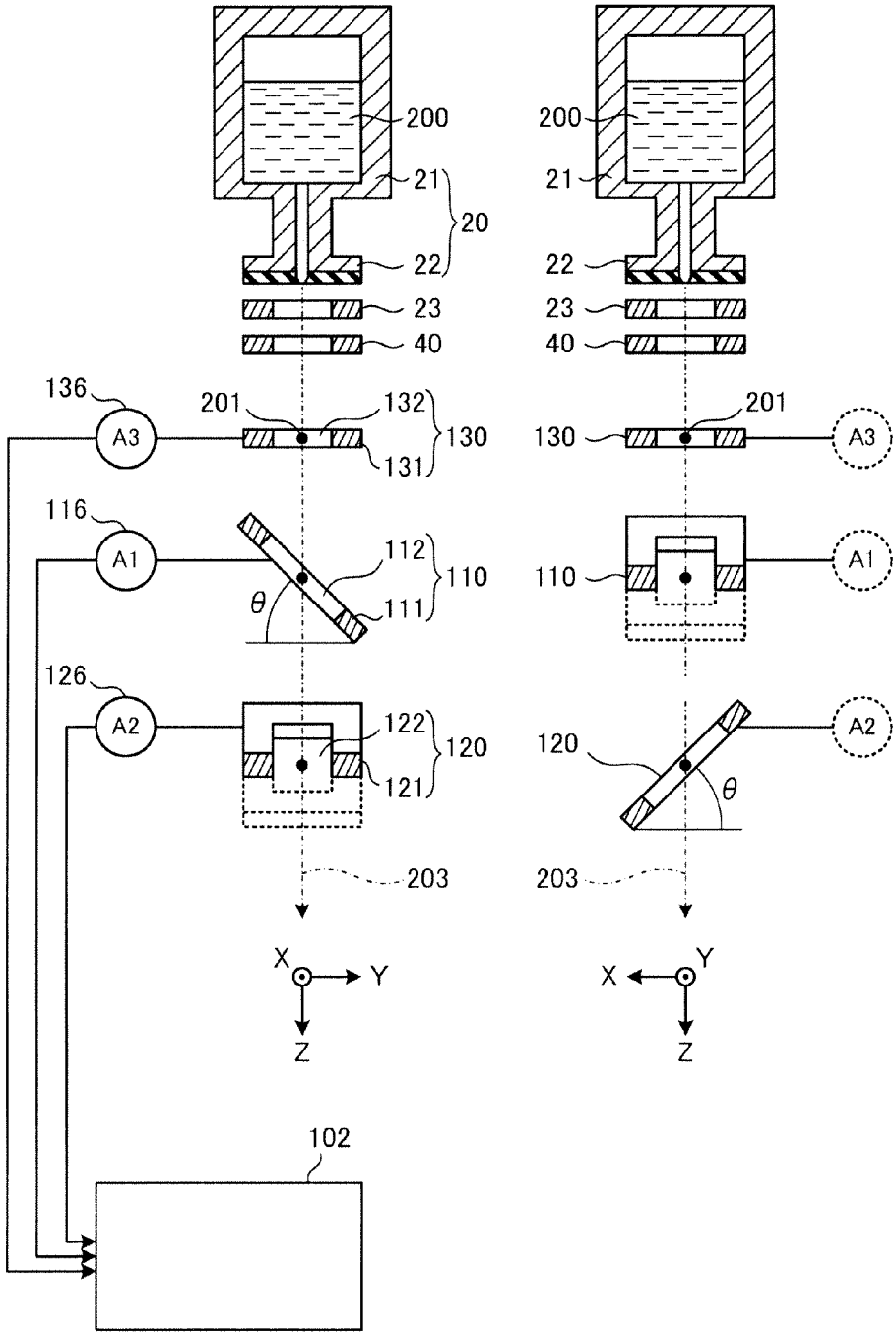
FIG. 4 schematically illustrates an arrangement of a plurality of droplet sensors.

FIG. 4 schematically illustrates the configuration of the group 101 of the droplet sensors. In the configuration shown in FIG. 4, an ideal trajectory or a designed trajectory of the droplet 201 is assumed to be the linear trajectory 203, and the description will be given using XYZ coordinate system in which the Z-axis represents the trajectory 203. In the first embodiment, three droplet sensors 110, 120, and 130 may be provided. The diagram on the left in FIG. 4 shows the configuration along the Y-Z plane, and the diagram on the right in FIG. 4 shows the configuration along the X-Z plane.

The first droplet sensor 110 may be disposed so as to be inclined at the predetermined angle θ about the X-axis. The first droplet sensor 110 may be disposed downstream of the third droplet sensor 130 along the trajectory 203, for example. The ammeter 116 of the first droplet sensor 110 may output a detection signal in response to the positional deviation of the droplet 201 in Y-direction.

The detection signal can show a change in the induced current over time measured by the ammeter 116. For example, the detection signal may be a current signal or a voltage signal. When the ammeter 116 has an amplification function, the detection signal may be an analogue signal. When, the ammeter 116 has an AD conversion function, the detection signal may be a digital signal. Alternatively, when the ammeter 116 has a photocoupler or the like, the detection signal may be an optical signal.

The second droplet sensor 120 may be disposed so as to be inclined at the predetermined angle θ about the Y-axis. An ammeter 126 of the second droplet sensor 120 may output a detection signal in response to the positional deviation of the droplet 201 in X-direction. In FIG. 4, the second droplet sensor 120 is disposed downstream of the first droplet sensor 110 along the trajectory 203. However, this disclosure is not limited thereto. The second droplet sensor 120 may be disposed upstream of the first droplet sensor 110.

The third droplet sensor 130 may be configured to detect the reference time Ts used to calculate the position of the droplet 201. In the first embodiment, the third droplet sensor 130 may be disposed at the side of the nozzle unit 22 of the droplet generator 20 and arranged in parallel to a plane orthogonal to the trajectory 203. In the first embodiment, an ammeter 136 of the third droplet sensor 130 may be configured to detect the passing timing of the droplet 201 as the reference time Ts.

In FIG. 4, the third droplet sensor 130 is disposed upstream of the first droplet sensor 110 along the trajectory 203, but this disclosure is not limited thereto. The third droplet sensor 130 may be disposed between the first droplet sensor 110 and the second droplet sensor 120. Alternatively, the third droplet sensor 130 may be disposed downstream of the second droplet sensor 120, that is, to the side of the plasma generation region PP.

Figure 5:
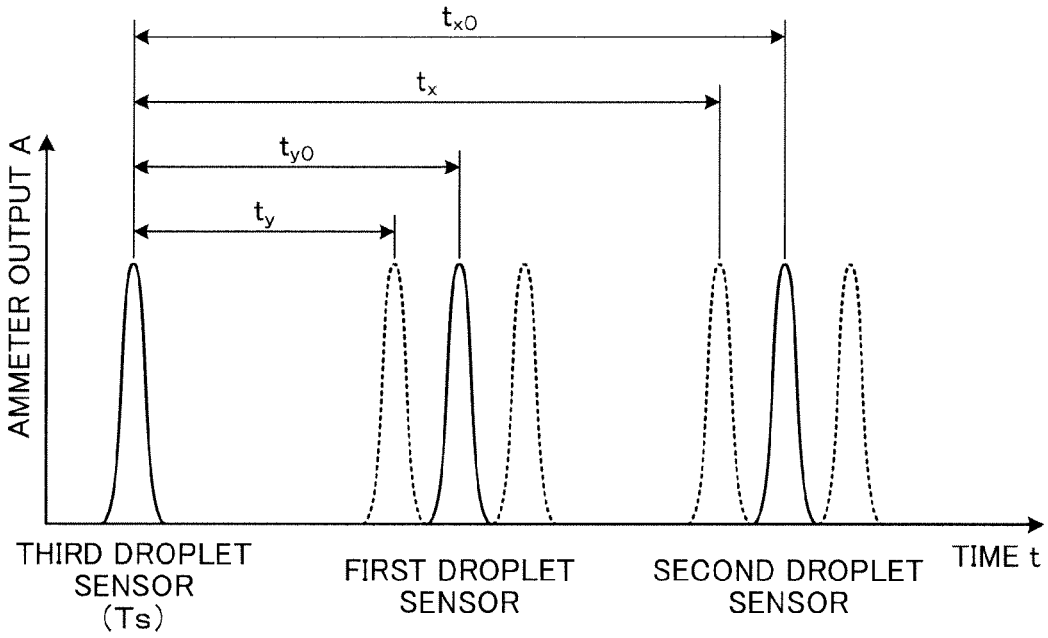
FIG. 5 is a timing chart illustrating outputs from the plurality of the droplet sensors.

FIG. 5 is a timing chart showing the current values outputted from the droplet sensors 110, 120, and 130.

The ammeter 136 of the third droplet sensor 130 may output a detection signal when the droplet 201 passes through the third droplet sensor 130. The detection signal (third detection signal) may be inputted to the droplet position detection circuit 102.

The droplet 201 having passed through the third droplet sensor 130 may pass through the first droplet sensor 110. The ammeter 116 of the first droplet sensor 110 may output a detection signal when the droplet 201 passes through the first droplet sensor 110. The detection signal (first detection signal) may be inputted to the droplet position detection circuit 102.

The droplet position detection circuit 102 may set the time at which the third detection signal reaches its peak as the reference time Ts, for example. Further, a temporal difference between the time at which the first detection signal reaches its peak and the reference time Ts may be set to the period $t_y$. A period from the reference time Ts to a time at which a current peak value is detected at the reference position (Y=0) in Y-direction in the first droplet sensor 110 may be set to the reference period $t_{y0}$. The reference period $t_{y0}$ in Y-direction may preferably be set in advance to the droplet position detection circuit 102.

The droplet 201 having passed the first droplet sensor 110 may then pass through the second droplet sensor 120. The ammeter 126 of the second droplet sensor 120 may output a detection signal when the droplet 201 passes through the second droplet sensor 120. The detection signal (second detection signal) may be inputted to the droplet position detection circuit 102.

A period from the reference time Ts to a time at which the current peak value is detected by the second droplet sensor 120 may be set to a period $t_x$. Further, a period from the reference time Ts to a time at which the current peak value is detected in the reference position (X=0) in X-direction may be set to a reference period $t_{x0}$. The reference period tx0 in X-direction may preferably be set in advance to the droplet position detection circuit 102.

The droplet position detection circuit 102 may calculate the positional deviation in Y-direction and the positional deviation in X-direction of the droplet 201 based on the detection signals from the droplet sensors 110, 120, and 130. The droplet position detection circuit 102 may, for example, be configured only of a hardware circuit or configured as a microcomputer system including a microprocessor, a memory, and so forth.

Figure 6:
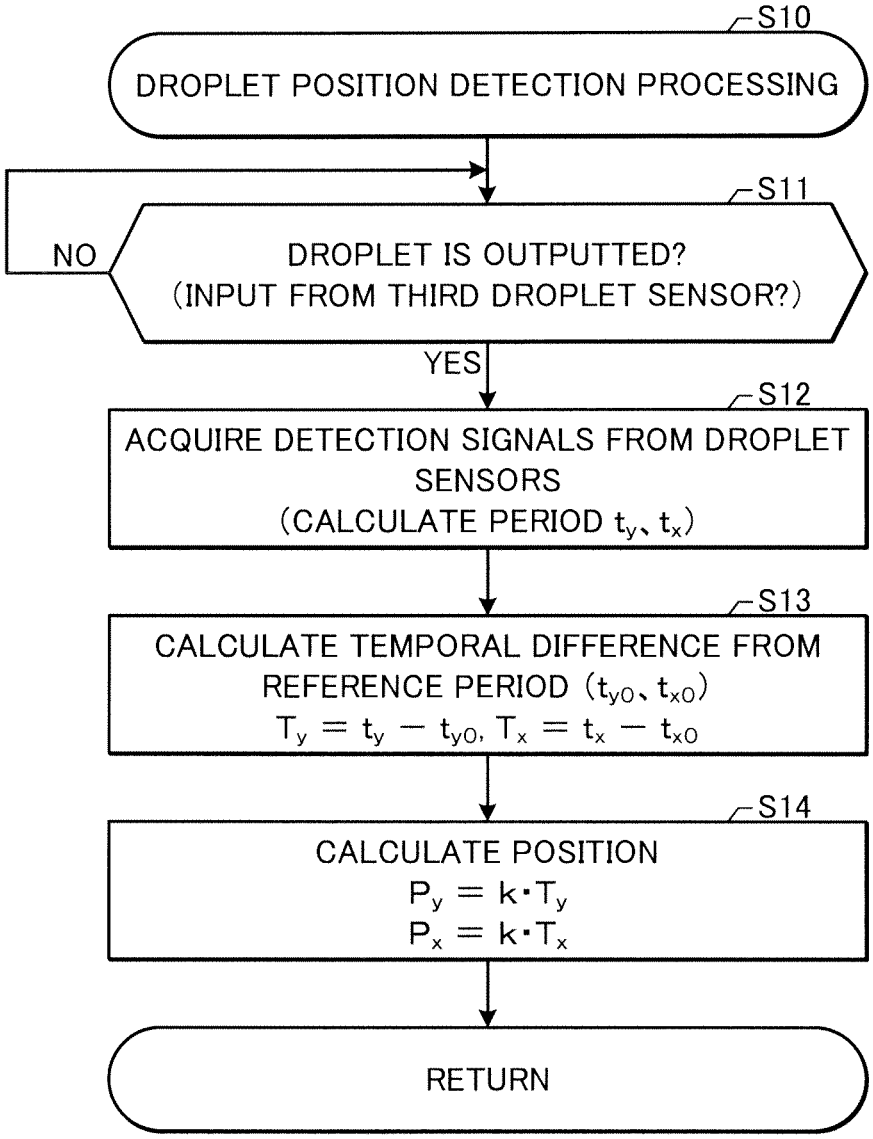
FIG. 6 is a flow chart illustrating processing for detecting the position of the charged droplet.

FIG. 6 is a flowchart showing processing for detecting the position of the droplet, executed by the droplet position detection circuit 102.

The droplet position detection circuit 102 may monitor whether or not the detection signal has been inputted from the third droplet sensor 130 (S11). The detection signal may be outputted from the third droplet sensor 130 when the droplet 201 outputted from the droplet generator 20 passes through the third droplet sensor 130. The detection signal may be inputted to the droplet position detection circuit 102.

The droplet position detection circuit 102, when the detection signal is inputted thereto from the third droplet sensor 130, may store a time at which the current value reaches its peak, for example, as the reference time Ts. Further, the droplet position detection circuit 102 may acquire the detection signals from the first droplet sensor 110 and the second droplet sensor 120, respectively (S12). The difference between the reference time Ts and the time at which the detection signal from the first droplet sensor is acquired may be represented as the period $t_y$, and the difference between the reference time Ts and the time at which the detection signal from the second droplet sensor 120 is acquired may be represented as the period $t_x$.

The droplet position detection circuit 102 may calculate the temporal difference $T_y$ in Y-direction and the temporal difference $T_x$ in X-direction (S13). The temporal difference $T_y$ in Y-direction may be obtained from Expression (1) above. Similarly, the temporal difference $T_x$ in X-direction may be obtained from Expression (4) below.

$$T_x = t_x - t_{x0} \tag{4}$$

The droplet position detection circuit 102 may calculate the droplet position $P_y$ in Y-direction and the droplet position $P_x$ in X-direction (S14). The droplet position detection circuit 102 may obtain the position $P_y$ of the droplet 201 in Y-direction by multiplying the temporal difference $T_y$ in Y-direction by a predetermined coefficient k, as in Expression (5) below.

$$P_y = k \cdot T_y \tag{5}$$

Similarly, the droplet position detection circuit 102 may obtain the position $P_x$ of the droplet 201 in X-direction by multiplying the temporal difference $T_x$ in X-direction by the coefficient k, as in Expression (6) below.

$$P_x = k \cdot T_x \tag{6}$$

Here, k is a coefficient for converting a temporal difference between a period ($t_y$, $t_x$) actually required for the droplet 201 to pass through a droplet sensor and a period to be required ($t_{y0}$, $t_{x0}$) for the droplet 201 to pass through the reference position (Y=0, X=0) into a position. The coefficient k may be obtained from Expression (7) below.

$$k = V/\tan\theta \tag{7}$$

In the first embodiment, since θ is set to 45 degrees, tan θ is equal to 1. Therefore, the coefficient k is equal to the velocity V of the droplet.

In the first embodiment, the droplet 201 may be detected using the induced electromotive force generated when the charged droplet 201 passes through the magnetic circuit (droplet sensors 110, 120, and 130). Accordingly, the droplet 201 may be detected even when some debris adheres to the magnetic circuit. The position of the droplet 201 according to the first embodiment can detect more accurately and precisely for a relatively long period of time than an embodiment of optically detecting the position of the droplet.

In the first embodiment, the droplet sensors 110 and 120 may be disposed so as to be inclined at the predetermined angle θ with respect to a plane orthogonal to the trajectory 203. Accordingly, the position of the droplet 201 may be calculated accurately and precisely based on the difference between the period actually required for the droplet to pass through the droplet sensor and the reference period for which the droplet 201 passes through the reference position (Y=0 or X=0) without the positional deviation.

Further, according to the first embodiment, since the predetermined angle θ is set to 45 degrees, the position of the droplet may be easily calculated.

Second Embodiment

Figure 7:
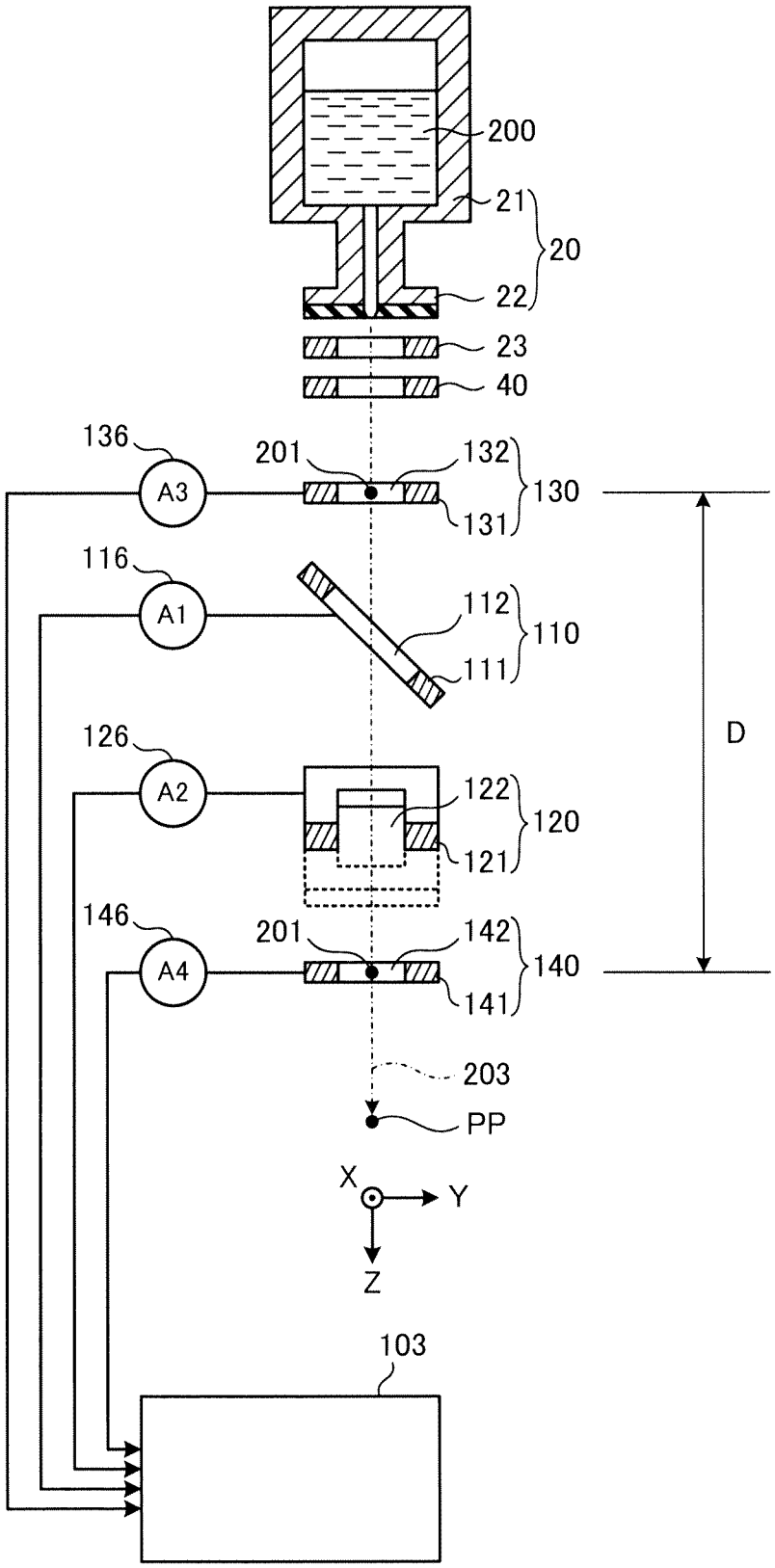
FIG. 7 is a general view of a droplet detection device according to a second embodiment.

A second embodiment will be described with reference to FIG. 7. Embodiments to be described below, including the second embodiment, may be modifications of the first embodiment. Thus, primarily, points which may differ from those of the first embodiment will be described. FIG. 7 illustrates the arrangement of the group of the droplet sensors along Y-Z plane.

As shown in FIG. 7, a fourth droplet sensor 140 may be added to the configuration shown in FIG. 4. The fourth droplet sensor 140 may be disposed to the side of the plasma generation region PP of the second droplet sensor 120. However, without being limited to the configuration shown in FIG. 7, it may be necessary that the fourth droplet sensor 140 be disposed with a space between the third droplet sensor 130 and the fourth droplet sensor 140. For example, the fourth droplet sensor 140 may be disposed between the first droplet sensor 110 and the second droplet sensor 120.

An ammeter 146 of the fourth droplet sensor 140 may output a detection signal when the droplet 201 passes through the fourth droplet sensor 140.

The detection signals from the droplet sensors 110, 120, 130, and 140 may be inputted to a droplet position/velocity detection circuit 103. The droplet position/velocity detection circuit 103 may be configured to detect the position and the velocity at which the droplet 201 passes through a predetermined observation plane (opening of the core).

The droplet position/velocity detection circuit 103 may be configured as a hardware circuit or as a microcomputer system, as in the droplet position detection circuit 102.

Here, a distance between the third droplet sensor 130 and the fourth droplet sensor 140 in the direction parallel to the trajectory 203 is designated as D. Timing at which the droplet 201 passes through the third droplet sensor 130 and the droplet position/velocity detection circuit 103 detects the detection signal is designated as $t_{d3}$. Timing at which the droplet 201 passes through the fourth droplet sensor 140 and the droplet position/velocity detection circuit 103 detects the detection signal is designated as $t_{d4}$.

The velocity V of the droplet 201 when the droplet 201 passes through the fourth droplet sensor 140 may be obtained from Expression (8) below.

$$V=D/(t_{d3}-t_{d4}) \quad (8)$$

As described with reference to S14 in FIG. 6, the velocity V of the droplet 201 may be used to calculate the position of the droplet 201. In the second embodiment, measuring the velocity V of the droplet 201 either regularly or randomly can determine the position of the droplet 201 more accurately and precisely.

Third Embodiment

Figure 8:
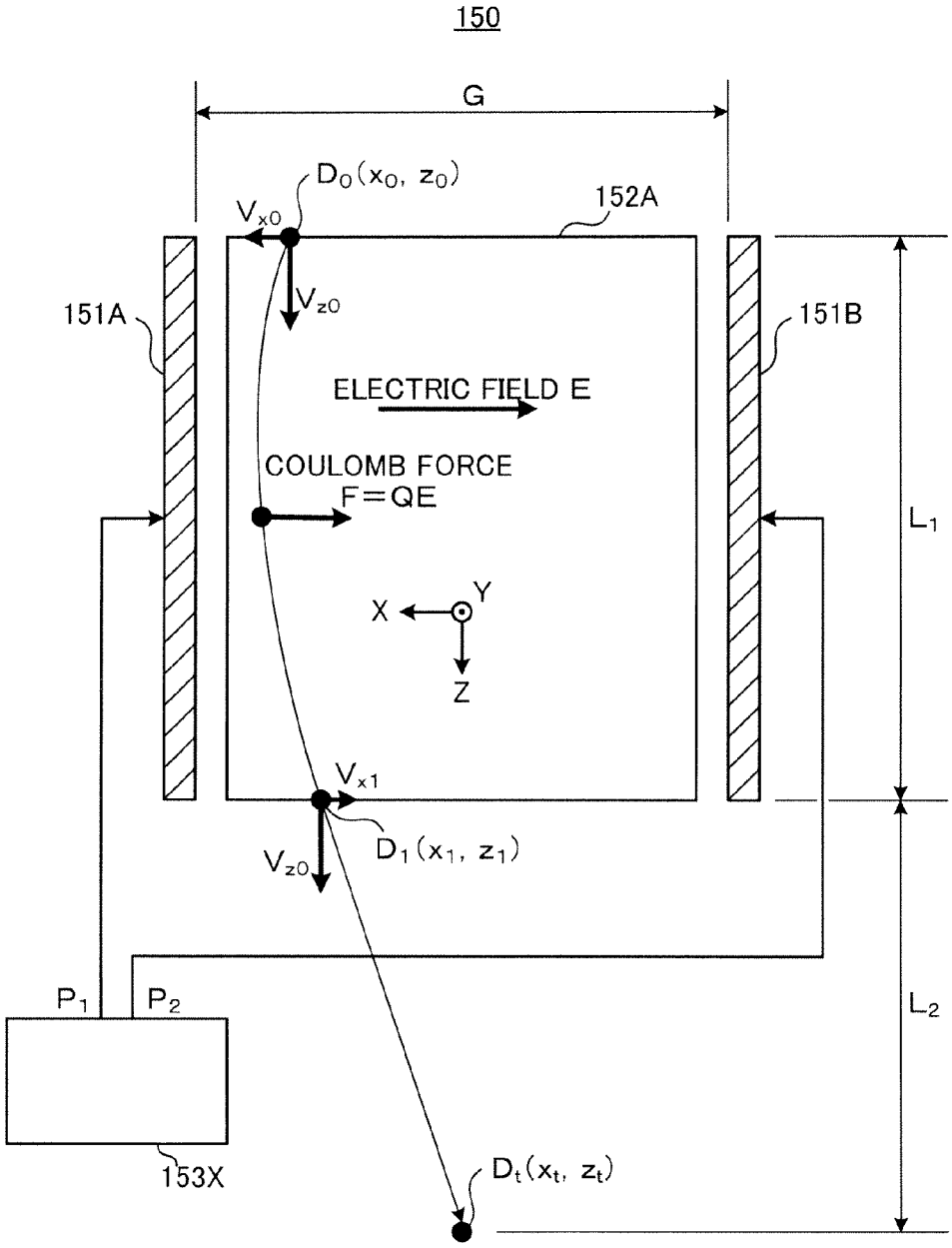
FIG. 8 schematically illustrates a configuration of a trajectory control unit for controlling a trajectory of a charged droplet according to a third embodiment.

A third embodiment will be described with reference to FIGS. 8 through 10. In the third embodiment, a trajectory control unit 150 may be provided for correcting the trajectory of the droplet 201.

The trajectory control unit 150 may include a first electrode pair 151A and 151B, a second electrode pair 152A and 152B, and a potential difference control units 153X and 153Y for generating a predetermined potential difference between the respective electrode pairs.

The first electrode pair 151A and 151B may be disposed with a space therebetween in X-direction. The second electrode pair 152A and 152B may be disposed with a space therebetween in Y-direction. The gap between the plate electrodes 151A and 151B constituting the first electrode pair and the gap between the plate electrodes 152A and 152B constituting the second electrode pair may have the same size G as each other.

A method for correcting the trajectory (traveling direction) of the droplet 201 with the first electrode pair 151A and 151B will be described below. Since the method for correcting the trajectory of the droplet 201 with the second electrode pair 152A and 152B may be similar, duplicate description thereof will be omitted herein.

The droplet 201 may have a charge Q. An electric field E having a predetermined potential gradient may be generated between the plate electrodes 151A and 151B by the potential difference control unit 153X.

When the droplet 201 enters the space between the first electrode pair 151A and 151B, the Coulomb force acts on the droplet 201 (Expression (9)).

$$F=QE \quad (9)$$

When the potential of the plate electrode 151A is set to $P_1$ and the potential of the plate electrode 151B is set to $P_2$, the electric field E may be calculated as follows: the potential difference between the first electrode pair 151A and 151B ($=P_1-P_2$) is divided by the gap size G (Expression (10)).

$$E=(P_1-P_2)/G \quad (10)$$

When the charged droplet 201 having the charge Q enters the electric field E, the Coulomb force F acts thereon. The Coulomb force may act either in the direction of the electric field E shown with the arrow in FIG. 8 or in the direction opposite thereto, depending on the polarity of the charge Q. When the mass of the droplet 201 is m and the acceleration provided to the droplet 201 by the Coulomb force F is a, the Coulomb force is represented in the expression F=ma. Expression (11) below is derived from the above expression and Expressions (9) and (10).

$$a=Q(P_1-P_2)/(mG) \quad (11)$$

A position of the charged droplet immediately prior to entering the electric field generated by the first electrode pair 151A and 151B is set to $D_0$ ($x_0$, $z_0$), and the velocity of the charged droplet at this time is set to V ($V_{x0}$, $V_{z0}$). $x_0$ and $z_0$ represent the position of the charged droplet in X-direction and Z-direction, respectively, and $V_{x0}$ and $V_{z0}$ represent the velocity component of the charged droplet in X-direction and Z-direction, respectively.

The length of the first electrode pair 151A and 151B in Z-direction is $L_1$, and the distance from the first electrode pair 151A and 151B to a targeted droplet position $D_x$ ($x_t$, $z_t$), which is in the plasma generation region, is $L_2$.

A period $t_1$ for which the charged droplet passes through the electric field E may be represented with Expression (12) below.

$$t_1=L_1/V_{z0} \quad (12)$$

A period $t_2$ for which the charged droplet, having passed through the electric field E, reaches the targeted droplet position $D_t$ may be represented with Expression (13) below.

$$t_2=L_2/V_{z0} \quad (13)$$

A velocity $V_{x1}$ of the charged droplet in X-direction immediately after the charged droplet has passed through the electric field E is represented with Expression (14) below.

$$V_{x1}=at_1+V_{x0} \quad (14)$$

A position $x_1$ of the charged droplet in X-direction immediately after the charged droplet has passed through the electric field E may be represented with Expression (15) below.

$$x_1=a(t_1)^2/2+V_{x0}t_1+x_0 \quad (15)$$

A targeted position $x_t$ of the charged droplet in X-direction may be represented with Expression (16) below.

$$x_t=V_{x1}t_2+x_1 \quad (16)$$

Controlling the potential $P_1$ and the potential $P_2$ of the first electrode pair 151A and 151B so as to satisfy Expression (16) above may allow the charged droplet to arrive at the targeted position.

FIG. 9 is a descriptive view in which the trajectory control unit 150 is added to the configuration shown in FIG. 4. The trajectory control unit 150 may be disposed between the second droplet sensor 120 and the plasma generation region PP. That is, the trajectory control unit 150 may be disposed between the mechanism for detecting the position of the droplet 201 (droplet sensors 110, 120, and 130) and the plasma generation region PP.

The first electrode pair 151A and 151B for correcting the trajectory of the droplet 201 in X-direction may be connected electrically to the X-direction potential difference control unit 153X. The second electrode pair 152A and 152B for correcting the trajectory of the droplet 201 in Y-direction may be connected electrically to the Y-direction potential difference control unit 153Y. The potential difference control units 153X and 153Y may be connected electrically to the droplet controller 100.

The droplet controller 100 may be configured for controlling the operation of the droplet generator 20. In addition, the droplet controller 100 may control the potentials to be applied to the first electrode 23 and the second electrode 40. Further, the droplet controller 100 of the third embodiment may be configured to detect the position of the droplet 201 in X-direction and in Y-direction based on the detection signals from the droplet sensors 110, 120, and 130. Furthermore, the droplet controller 100 of the third embodiment may be configured to output a control signal to the potential difference control units 153X and 153Y based on the detection result of the position of the droplet 201.

Figure 10:
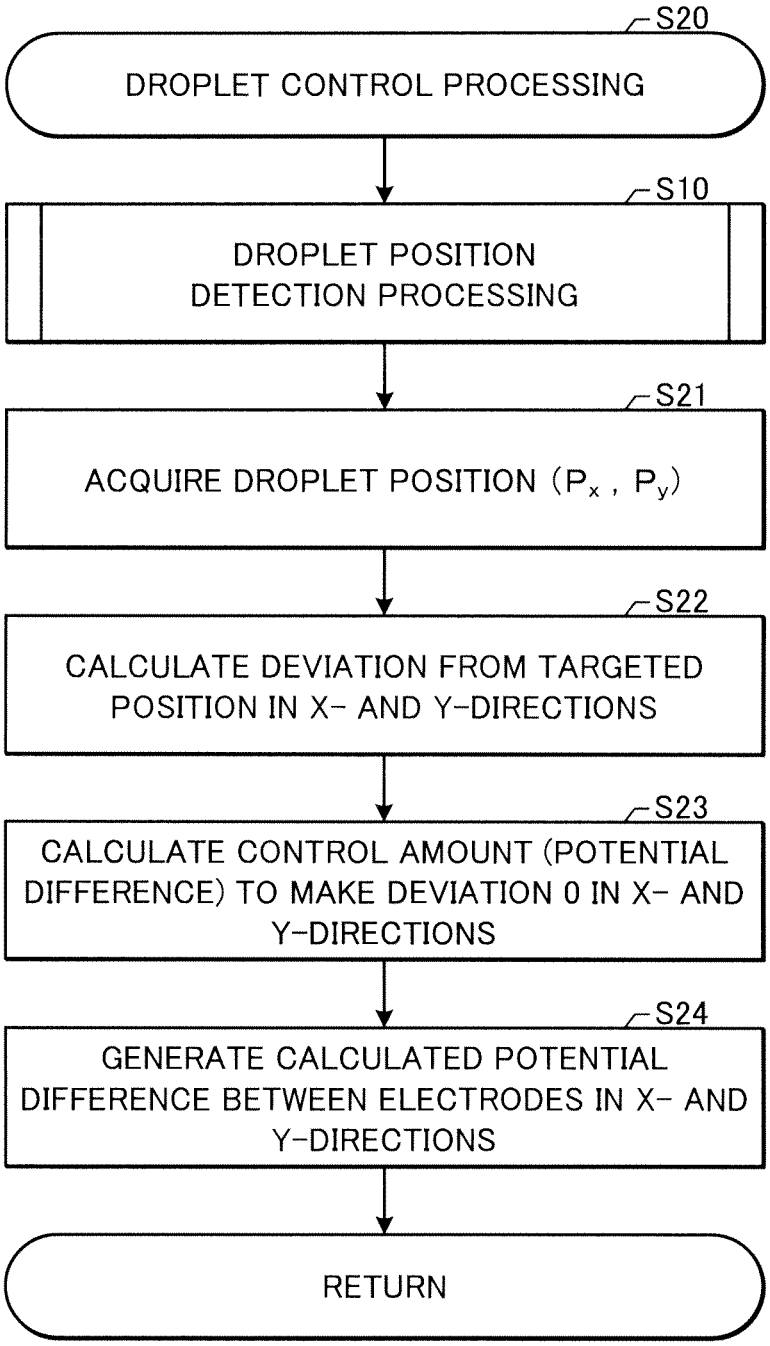
FIG. 10 is a flow chart illustrating processing for controlling the position of the charged droplet.

FIG. 10 is a flowchart illustrating droplet control processing executed by the droplet controller 100. The droplet controller 100 may first execute the droplet position detection processing described with reference to FIG. 6 (S10).

The droplet controller 100 may then acquire a droplet position calculated in S10 and obtain a deviation from the targeted position (plasma generation region pp) set in advance (S22).

Then, the droplet controller 100 may calculate the control amount to control the deviation calculated in S22 to be 0 in X-direction and in Y-direction (S23). The droplet controller 100 may provide the control amount calculated in S23 to the potential difference control units 153X and 153Y (S24).

Accordingly, a potential difference may be generated between the first electrode pair 151A and 151B, and the trajectory 203X of the droplet 201 may be shifted to a trajectory 203*x*1. Similarly, a predetermined potential difference may be generated between the second electrode pair 152A and 152B, and the trajectory 203*y* of the droplet 201 may be shifted to a trajectory 203*y*1. In this way, in the third embodiment, the trajectory of the droplet 201 may be corrected so that the droplet 201 may arrive at the plasma generation region PP. Note that the third embodiment may be combined with the second embodiment described with reference to FIG. 7.

Further, without being limited to the case in which the trajectory of the droplet 201 is corrected with the Coulomb force using the electric field, the trajectory of the droplet 201 may be corrected with other physical forces. For example, a device for generating a magnetic field in a region containing part of the trajectory of the droplet 201 may be provided to correct the trajectory of the droplet 201 with the Lorentz force.

Fourth Embodiment

Figure 11:
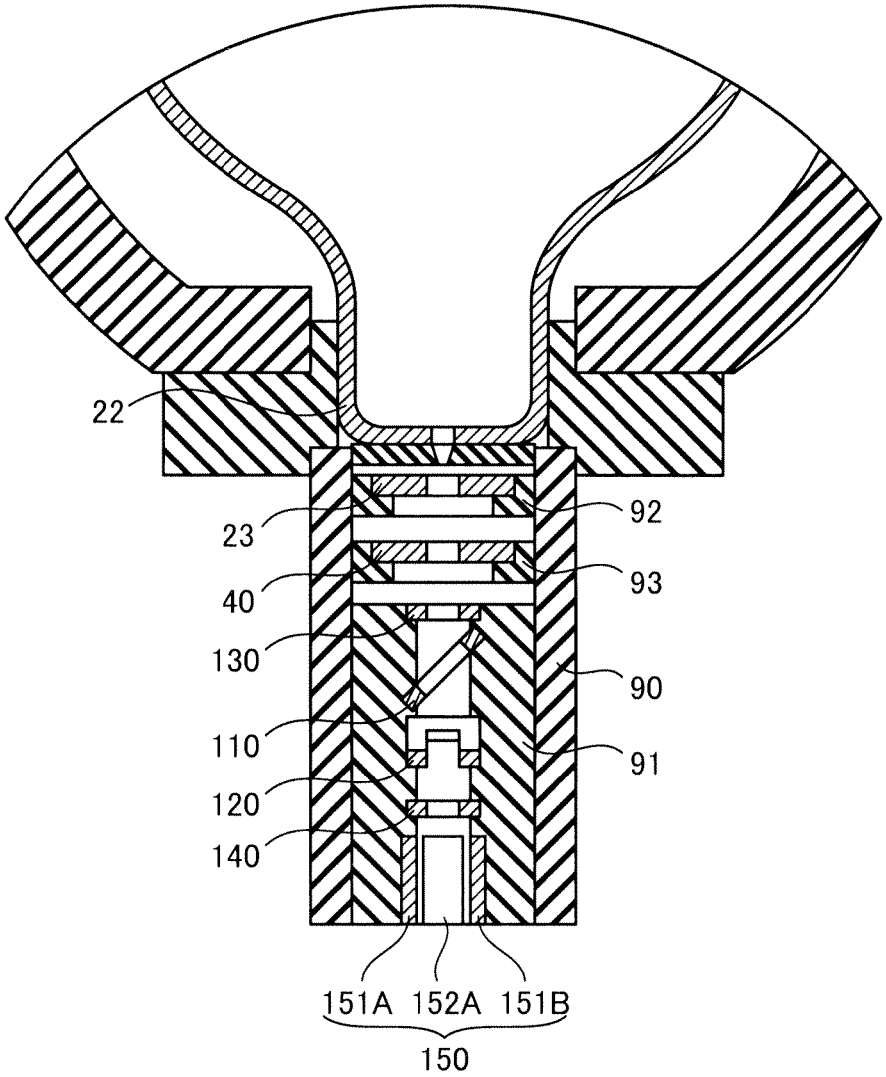
FIG. 11 is a fragmentary sectional view of a charged droplet generation device according to a fourth embodiment.

A fourth embodiment will be described with reference to FIG. 11. FIG. 11 is a sectional view illustrating a droplet output unit and the vicinity thereof of a charged droplet generation unit. In the fourth embodiment, the mechanism for generating and accelerating the charged droplet 201 (first electrode 23 and second electrode 40), the mechanism for detecting the position of the droplet 201 (droplet sensors 110, 120, 130, and 140), and the mechanism for controlling the trajectory of the droplet 201 (plate electrodes 151A, 151B, 152A, and 152B (not shown) of the trajectory control unit 150) may be integrally configured.

A cylindrical support 90 may be provided at the leading end side of the nozzle unit 22. Disposed inside the support 90 may be the first electrode 23, the second electrode 40, the droplet sensors 110, 120, 130, and 140, and the plate electrodes 151A, 151B, 152A, and 152B.

The droplet sensors 110, 120, 130, and 140, and the plate electrodes 151A, 151B, 152A, and 152B may be fixed in the support 90 with an insulator 91. The first electrode 23 and the second electrode 40 may be mounted in the support 90 with insulators 92 and 93, respectively.

A sensor mount member for fixing the droplet sensors 110, 120, 130, and 140 to the support 90 may be configured separately from an electrode mount member for fixing the plate electrodes 151A, 151B, 152A, and 152B to the support 90. In this case, the sensor mount member may be made of a nonmagnetic material, such as an aluminum alloy, for example.

In the fourth embodiment, the electrodes 23, 40, 151A, 151B, 152A, and 152B, and the droplet sensors 110, 120, 130, and 140 may be integrated, which can position them accurately and precisely with respect to one another.

Fifth Embodiment

Figure 12:
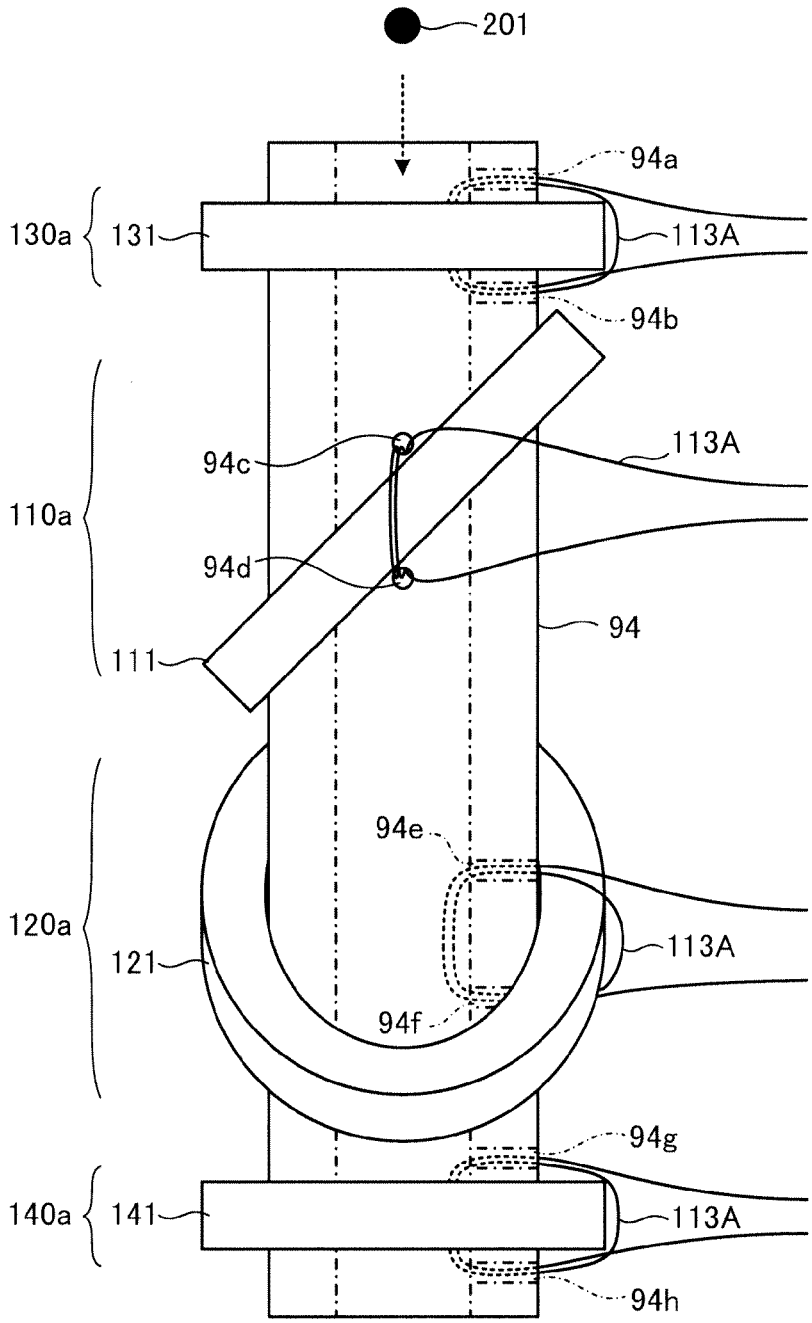
FIG. 12 is a side view of a group of droplet sensors according to a fifth embodiment.

A fifth embodiment will be described with reference to FIG. 12. In the fifth embodiment, the mechanism for detecting the position of the droplet 201 (droplet sensors 110*a*, 120*a*, 130*a*, and 140*a*) may be fixed around a cylindrical body 94 of a nonmagnetic material, such as ceramics. The cylindrical body 94 may be made, for example, of alumina ($Al_2O_3$), aluminum nitride (AlN), or the like. The droplet sensors 110*a*, 120*a*, 130*a*, and 140*a* may be configured similarly to the droplet sensors 110, 120, 130, and 140, except their shapes.

In the fifth embodiment as well, the droplet sensors 110*a*, 120*a*, 130*a*, and 140*a* may be integrated, which can position them accurately and precisely with respect to one another.

Further, holes 94*a* through 94*h* may be formed in the side surface of the cylindrical body 94, and conductive bodies 113A may be inserted through these holes to constitute coils. This may allow the droplet sensors 110*a*, 120*a*, 130*a*, and 140*a* to be disposed closely to one another with a simple configuration. Further, since the configuration is relatively simple, each core may be made smaller in size. Accordingly, the length of the flux path of the magnetic circuit may become shorter, and thus the detection sensitivity of the charged droplet may be improved.

Sixth Embodiment

Figure 13A:
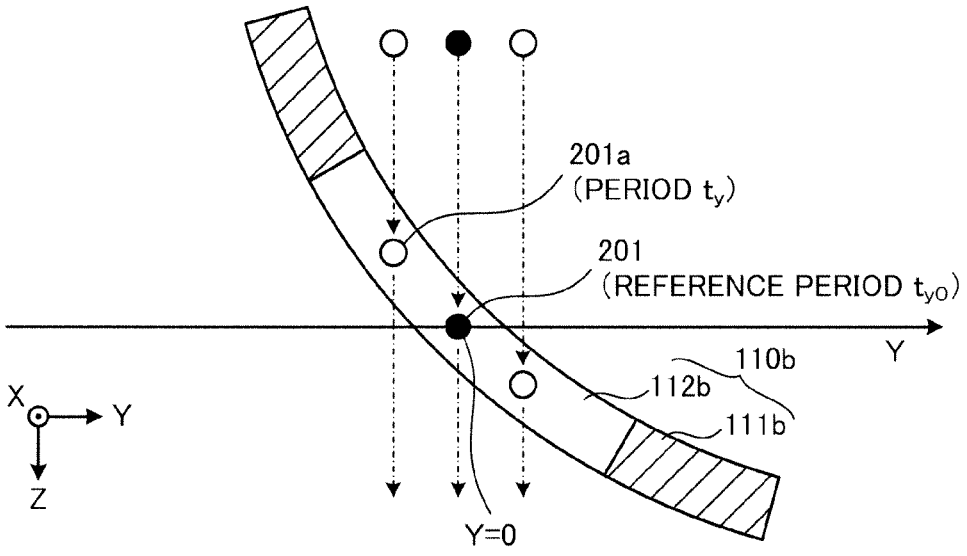
FIG. 13A is a descriptive view illustrating a detection mechanism in a case where a core of a droplet sensor is formed in a curved shape according to a sixth embodiment.
Figure 13B:
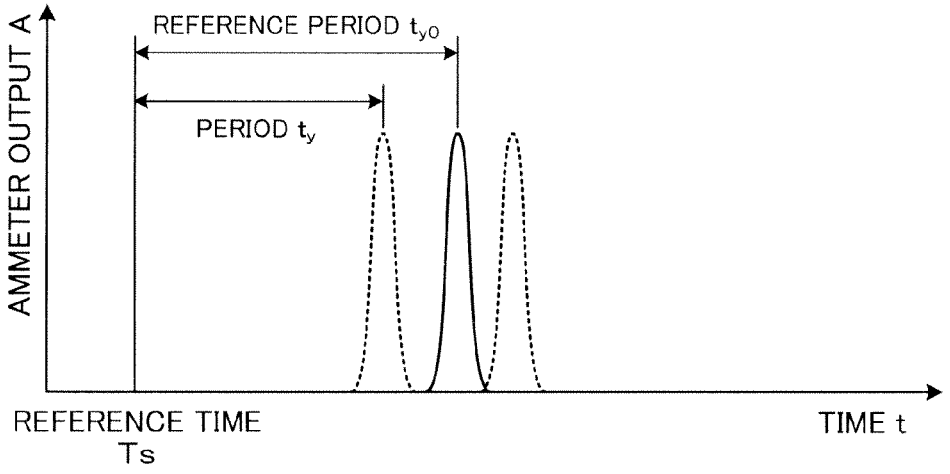
FIG. 13B is a timing chart illustrating the detection mechanism in the case where the core of the droplet sensor is formed in a curved shape.

A sixth embodiment will be described with reference to FIGS. 13A and 13B. In the sixth embodiment, a curved core 111*b* may be used. The core 111*b* used as a first droplet sensor 110*b* will be described as an example below. The core 111*b* may be formed in a loop having an opening 112*b*. Surfaces through which the opening 112*b* is formed may be curved. When the curve can be described with a function, the relationship between the position of the droplet 201 in Y-direction and the passing timing $t_y$ may be determined geometrically. For example, the position of the droplet 201 in Y-direction may be calculated with an expression $Y=f(t_y-t_{y0})$. The position of the droplet 201 in X-direction may also be calculated similarly.

In this way, a surface along which the magnetic circuit is formed may not necessarily be planar, and may be curved, as long as the shape thereof can be approximated using a function or a numerical value.

Seventh Embodiment

Figure 14:
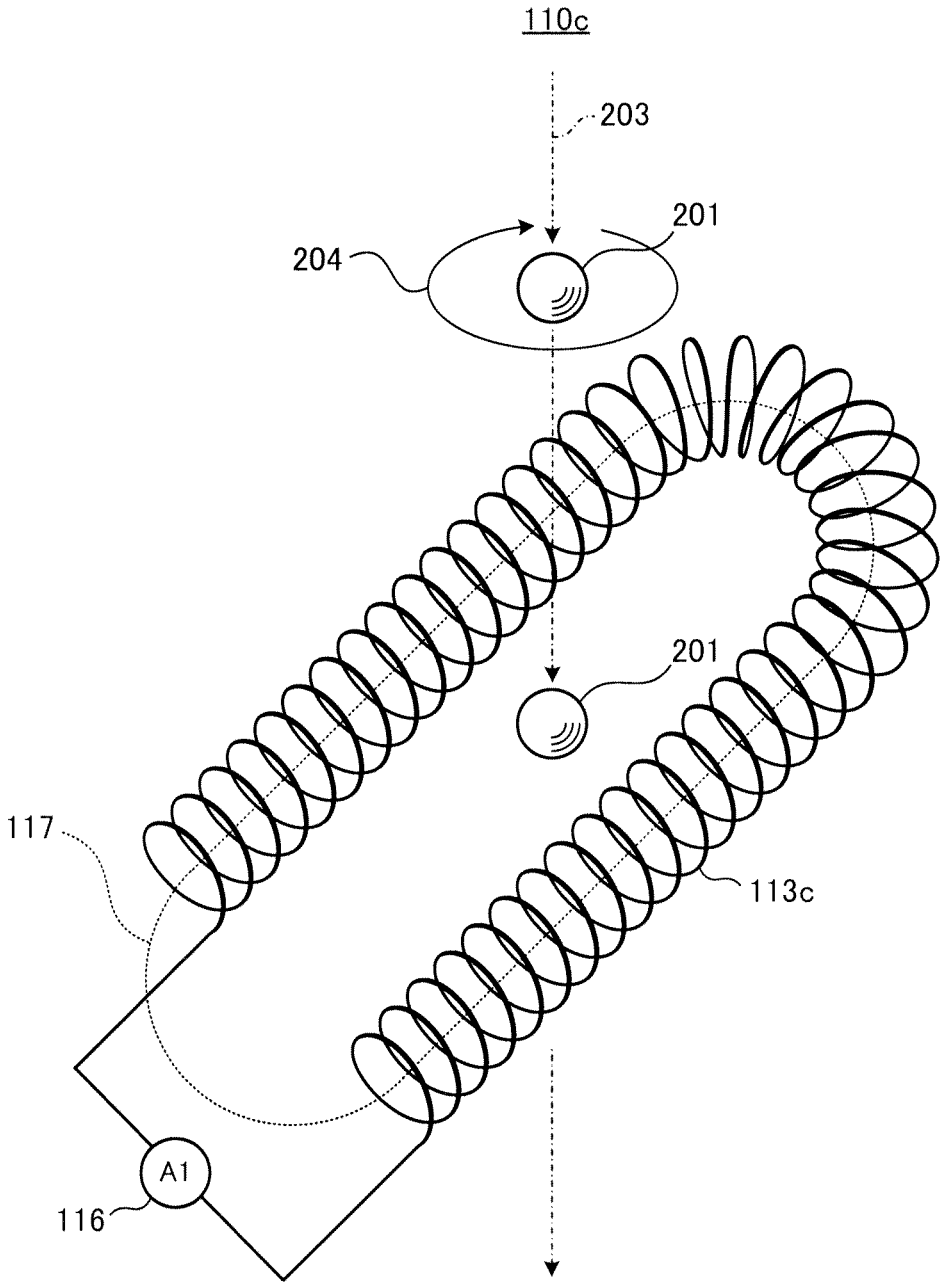
FIG. 14 is a perspective view of a droplet sensor without a core according to a seventh embodiment.

A seventh embodiment will be described with reference to FIG. 14. In the seventh embodiment, the droplet sensor may not have a core. As shown in FIG. 14, for example, a magnetic circuit 117 may be implemented by a solenoid coil 113*c* without a core, as in a first droplet sensor 110*c*. A magnetic field 204 may be generated around the trajectory 203 of the charged droplet 201 when the charged droplet 201 passes through the magnetic circuit 117. When the charged droplet 201 passes through a region surrounded by the magnetic circuit 117 including the solenoid coil 113*c*, the induced electromotive force may be generated to the solenoid coil 113*c* due to the magnetic field 204. The induced electromotive force may be detected by the ammeter 116. Therefore, the passage of the charged droplet 201 may be detected.

The above-described embodiments and the modifications thereof are merely examples for implementing this disclosure, and this disclosure is not limited thereto. Making various modifications according to the specifications or the like is within the scope of this disclosure, and it is apparent from the above description that other various embodiments are possible within the scope of this disclosure. For example, it is needless to state that the modifications illustrated for each of the embodiments can be applied to other embodiments as well.

The terms used in this specification and the appended claims should be interpreted as "non-limiting." For example, the terms "include" and "be included" should be interpreted as "not limited to the stated elements." The term "have" should be interpreted as "not limited to the stated elements." Further, the modifier "one (a/an)" should be interpreted as "at least one" or "one or more."

What is claimed is:

1. A droplet generation and detection device, comprising:

a droplet generation unit configured for outputting a charged droplet;

at least one droplet sensor including:

a magnetic circuit including a coil of an electrically conductive material, the magnetic circuit being disposed such that the charged droplet passes around the magnetic circuit; and a current detection unit configured for detecting current flowing through the coil and outputting a detection signal; and a signal processing circuit configured for detecting the charged droplet based on the detection signal, wherein:

the at least one droplet sensor includes a first droplet sensor and a second droplet sensor, and the magnetic circuit of the first droplet sensor and the magnetic circuit of the second droplet sensor are disposed such that loop planes thereof are inclined in different directions from each other with respect to a trajectory of the charged droplet.

2. The droplet generation and detection device according to claim 1, wherein the signal processing circuit:

measures an amount of positional deviation in a first direction, based on timing at which the detection signal is outputted from the first droplet sensor, and measures an amount of positional deviation in a second direction, based on timing at which the detection signal is outputted from the second droplet sensor.

3. A droplet generation and detection device, comprising:

a droplet generation unit configured for outputting a charged droplet;

at least one droplet sensor including:

a magnetic circuit including a coil of an electrically conductive material, the magnetic circuit being disposed such that the charged droplet passes around the magnetic circuit; and a current detection unit configured for detecting current flowing through the coil and outputting a detection signal; and a signal processing circuit configured for detecting the charged droplet based on the detection signal, wherein:

the at least one droplet sensor includes a first droplet sensor and a second droplet sensor, the magnetic circuit of the first droplet sensor is disposed so as to be inclined at a predetermined angle with respect to a trajectory of the charged droplet, the magnetic circuit of the second droplet sensor is disposed such that a loop plane thereof is inclined at an angle closer to 90 degrees than the predetermined angle with respect to the trajectory of the charged droplet, and the signal processing circuit measures a position at which the charged droplet passes through the magnetic circuit of the first droplet sensor, based on a temporal difference between timing at which the detection signal is outputted from the first droplet sensor and timing at which the detection signal is outputted from the second droplet sensor.

4. The droplet generation and detection device according to claim 3, wherein:

the at least one droplet sensor includes a third droplet sensor disposed so as to be spaced from the second droplet sensor, and the signal processing circuit detects the speed of the charged droplet, based on timing at which the detection signal is outputted from the second droplet sensor and timing at which the detection signal is outputted from the third droplet sensor.

5. A droplet control device, comprising:

at least one droplet sensor including:

a magnetic circuit including a coil configured of an electrically conductive material; and a current detection unit configured for detecting current flowing in the coil and outputting a detection signal;

a signal processing circuit configured for detecting a charged droplet based on the detection signal from the droplet sensor; and a trajectory control unit for controlling a trajectory of the charged droplet, wherein:

the at least one droplet sensor includes a first droplet sensor and a second droplet sensor, and the magnetic circuit of the first droplet sensor and the magnetic circuit of the second droplet sensor are disposed such that loop planes thereof are inclined in different directions from each other with respect to a trajectory of the charged droplet.

6. An extreme ultraviolet light generation chamber used in an extreme ultraviolet light generation apparatus, the extreme ultraviolet light generation chamber comprising:

a chamber body;

a droplet generation unit configured for outputting a charged droplet into the chamber body;

at least one droplet sensor including:

a magnetic circuit including a coil of an electrically conductive material, the magnetic circuit being disposed such that the charged droplet passes around the magnetic circuit; and a current detection unit configured for detecting current flowing through the coil and outputting a detection signal;

a signal processing circuit configured for detecting the charged droplet based on the detection signal from the droplet sensor; and a trajectory control unit configured for controlling a trajectory of the charged droplet, and wherein:

the at least one droplet sensor includes a first droplet sensor and a second droplet sensor, and the magnetic circuit of the first droplet sensor and the magnetic circuit of the second droplet sensor are disposed such that loop planes thereof are inclined in different directions from each other with respect to a trajectory of the charged droplet.

7. A method for controlling a position of a charged droplet in an extreme ultraviolet light generation apparatus, the method comprising:

disposing, around a trajectory of a charged droplet, at least one droplet sensor including:

a magnetic circuit including a coil of an electrically conductive material; and a current detection unit configured for detecting current flowing through the coil and outputting a detection signal;

controlling the droplet generation unit to output the charged droplet;

detecting the charged droplet based on the detection signal from the droplet sensor; and generating an electric field in a region containing a part of the trajectory of the charged droplet, the direction of the electric field intersecting the trajectory, wherein:

the at least one droplet sensor includes a first droplet sensor and a second droplet sensor, and the magnetic circuit of the first droplet sensor and the magnetic circuit of the second droplet sensor are disposed such that the planes thereof are inclined in different directions from each other with respect to a trajectory of the charged droplet.

8. A droplet control device, comprising:

at least one droplet sensor including:

a magnetic circuit including a coil configured of an electrically conductive material; and a current detection unit configured for detecting current flowing in the coil and outputting a detection signal;

a signal processing circuit configured for detecting a charged droplet based on the detection signal from the droplet sensor; and a trajectory control unit for controlling a trajectory of the charged droplet, wherein:

the at least one droplet sensor includes a first droplet sensor and a second droplet sensor, the magnetic circuit of the first droplet sensor is disposed so as to be inclined at a predetermined angle with respect to a trajectory of the charged droplet, the magnetic circuit of the second droplet sensor is disposed such that a loop plane thereof is inclined at an angle closer to 90 degrees than the predetermined angle with respect to the trajectory of the charged droplet, and the signal processing circuit measures a position at which the charged droplet passes through the magnetic circuit of the first droplet sensor, based on a temporal difference between timing at which the detection signal is outputted from the first droplet sensor and timing at which the detection signal is outputted from the second droplet sensor.

9. An extreme ultraviolet light generation chamber used in an extreme ultraviolet light generation apparatus, the extreme ultraviolet light generation chamber comprising:

a chamber body;

a droplet generation unit configured for outputting a charged droplet into the chamber body;

at least one droplet sensor including:

a magnetic circuit including a coil of an electrically conductive material, the magnetic circuit being disposed such that the charged droplet passes around the magnetic circuit; and a current detection unit configured for detecting current flowing through the coil and outputting a detection signal;

a signal processing circuit configured for detecting the charged droplet based on the detection signal from the droplet sensor; and a trajectory control unit configured for controlling a trajectory of the charged droplet, wherein:

the at least one droplet sensor includes a first droplet sensor and a second droplet sensor, the magnetic circuit of the first droplet sensor is disposed so as to be inclined at a predetermined angle with respect to a trajectory of the charged droplet, the magnetic circuit of the second droplet sensor is disposed such that a loop plane thereof is inclined at an angle closer to 90 degrees than the predetermined angle with respect to the trajectory of the charged droplet, and the signal processing circuit measures a position at which the charged droplet passes through the magnetic circuit of the first droplet sensor, based on a temporal difference between timing at which the detection signal is outputted from the first droplet sensor and timing at which the detection signal is outputted from the second droplet sensor.

10. A method for controlling a position of a charged droplet in an extreme ultraviolet light generation apparatus, the method comprising:

disposing, around a trajectory of a charged droplet, at least one droplet sensor including:

a magnetic circuit including a coil of an electrically conductive material; and a current detection unit configured for detecting current flowing through the coil and outputting a detection signal;

controlling the droplet generation unit to output the charged droplet;

detecting the charged droplet based on the detection signal from the droplet sensor; and generating an electric field in a region containing a part of the trajectory of the charged droplet, the direction of the electric field intersecting the trajectory, wherein:

the at least one droplet sensor includes a first droplet sensor and a second droplet sensor, the magnetic circuit of the first droplet sensor is disposed so as to be inclined at a predetermined angle with respect to a trajectory of the charged droplet, the magnetic circuit of the second droplet sensor is disposed such that a loop plane thereof is inclined at an angle closer to 90 degrees than the predetermined angle with respect to the trajectory of the charged droplet, and the signal processing circuit measures a position at which the charged droplet passes through the magnetic circuit of the first droplet sensor, based on a temporal difference between timing at which the detection signal is outputted from the first droplet sensor and timing at which the detection signal is outputted from the second droplet sensor.

* * * * *